United States Patent [19]

Prieur et al.

[11] 4,256,297

[45] Mar. 17, 1981

[54] HOPPER

[75] Inventors: Lucien Prieur, Ecouen; Patrick Pinard, Seiches-le-Loir, both of France

[73] Assignee: Compagnie Internationale pour l'Informatique, Paris, France

[21] Appl. No.: 75,228

[22] Filed: Sep. 13, 1979

[30] Foreign Application Priority Data

Sep. 21, 1978 [FR] France ..... 78 27037

[51] Int. Cl.[3] ..... B65H 31/02

[52] U.S. Cl. ..... 271/207; 271/185; 271/258; 271/305; 414/97

[58] Field of Search ..... 271/207–211, 271/213–215, 217, 219–224, 256, 258, 259, 279, 287, 303, 305, 184, 185, 176, 199, 260, 261; 340/674; 250/223 R; 209/933, 554, 900; 414/97; 198/954

[56] References Cited

U.S. PATENT DOCUMENTS

| | | | |
|---|---|---|---|
| 2,461,418 | 2/1949 | Ford | 271/305 X |
| 3,006,641 | 10/1961 | Souchot | 271/215 |
| 3,137,499 | 6/1964 | Maidment | 271/219 X |
| 3,682,328 | 8/1972 | Turner et al. | 271/215 |

*Primary Examiner*—Bruce H. Stoner, Jr.

*Attorney, Agent, or Firm*—Kerkam, Stowell, Kondracki & Clarke

[57] ABSTRACT

A hopper for receiving documents, such as checks, fed on edge from a conveyor and adapted to be stacked one atop the other inside the hopper includes a slot in one wall of the hopper through which a portion of a check projects when the stack reaches a predetermined height. A detector in the form of a light emitting member and light receiver is disposed on respective sides of the slot outside the hopper to provide a control signal when the light beam is interrupted due to projection of a portion of a check to signal when the stack has reached a predetermined height.

13 Claims, 3 Drawing Figures

HOPPER

BACKGROUND OF THE INVENTION

1. FIELD OF THE INVENTION

In general terms, the invention relates to a hopper for receiving documents, such as sheets, which stack up on one another as they enter the hopper, and in particular a hopper which is fitted with a system for detecting when it is full of sheets, such as checks.

2. DESCRIPTION OF THE PRIOR ART

In all fields, there are more and more documents which have to be handled. To accelerate the handlng process, it is necessary for automatic or semi-automatic sorting to take place. This is particularly the case wherever documents such as checks are involved. At the output end of document handling machines, receiving hoppers are provided to which the documents are switched as a function of the sorting criteria. Given that each hopper contains a limited receiving space, it is advantageous, for obvious reasons, to provide a system for detecting when a hopper is full.

Such systems are known, but known systems have the disadvantage of being relatively complicated owing to the fact that they involve special guiding devices and detecting devices which prevent them from having the versatility which can justifiably be expected from them.

SUMMARY OF THE INVENTION

The present invention has as an object of providing a hopper for receiving documents which is associated with a simple detection system having only a small number of parts, and which has a high degree of reliability.

To this end, the invention provides a hopper for receiving and stacking sheets one atop another. The hopper is fitted with a system for detecting when it is full of sheets. The detection system is formed by at least one slot provided in one of the walls of the hopper in which at least part of a sheet is able to engage when the stack of sheets reaches a predetermined height and means are provided for detecting the presence in the hopper of a sheet of which at least part projects out of the hopper through the said slot.

In accordance with another feature of the invention, the detecting arrangement detects the presence of that part of a sheet which projects through the said slot.

In accordance with another feature of the invention, the detecting arrangement is formed by a light emitting member and a light receiver which are mounted on respective sides of the aforesaid slot outside of the hopper.

In accordance with another feature of the invention, the space within the hopper is defined on the one hand by two longitudinal walls which form a certain angle between them and whose common longitudinal edge defines the bottom of the hopper, one longitudinal wall forming a supporting surface for the sheets and the other longitudinal wall forming a retaining surface for the longitudinal edges of the sheets, and on the other hand by at least one transverse wall.

In accordance with another feature of the invention, the aforesaid slot is provided in the longitudinal wall which forms the retaining surface.

In accordance with another feature of the invention, the aforesaid slot is substantially parallel to the common edge of the two longitudinal walls of the hopper.

In accordance with another feature of the invention, the aforesaid slot extends substantially from one of the aforesaid transverse walls of the hopper for a greater than half the length of a sheet.

In accordance with yet another feature of the invention, the end of the slot opposite from the aforesaid transverse wall forms a pivoting surface for the first sheet which is caused to engage in the slot.

In accordance with another feature of the invention, the sheets enter the hopper at the region of the transverse wall of the hopper which is opposite to the wal adjacent the aforesid slot.

BRIEF DESCRIPTION OF THE DRAWINGS

Other advantages, features and details will become clearer from the following explanatory description, which is given, solely by way of example, with reference to the accompanying drawings, in which.

DETAILED DESCRIPTION OF THE PREFERRED EMBODIMENT

Figure 1:
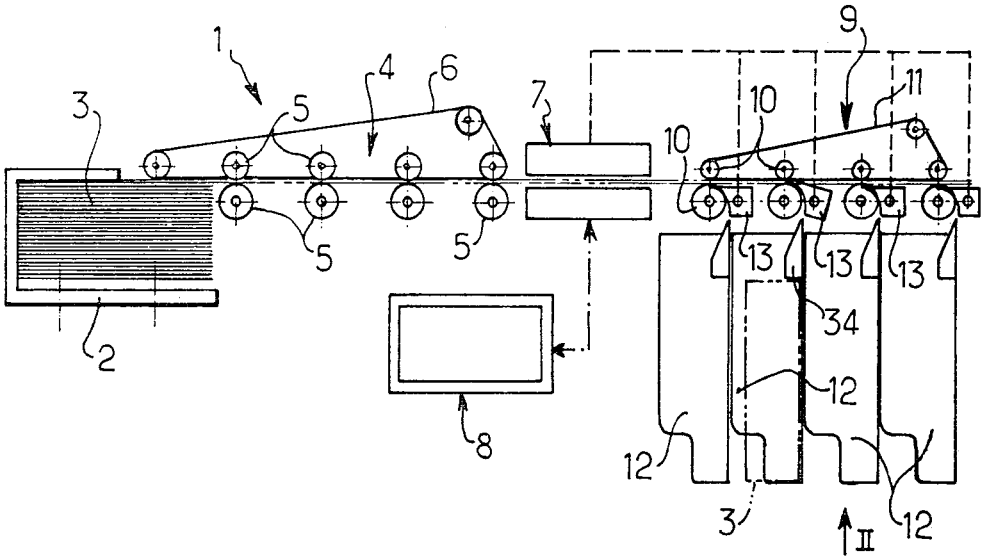
FIG. 1 is a diagrammatic view from about of a sorting machine having a series of hoppers according to the invention.

The sorting machine 1, which is shown diagrammatically in FIG. 1, includes a holder 2 adapted to receive a pack of documents 3, such as checks, which are to be processed. The checks 3 are extracted and processed one by one on edge by a conveyor arrangement 4, which employs rollers 5 and a belt 6, for example. Conveyor 4 translates the checks through a processing unit having associated therewith a control unit 8 of known type. Once it has been processed through the processing unit 7, each check 3 is then taken up by a second conveyor 9, of the type employing rollers 10 and a belt 11, for example, before being directed into one of the receiving hoppers 12 as a function in particular of the information which it carries. The diversion into one of the receiving hoppers 12 is performed by means of diverting devices 13 situated along the conveyor 9 which are controlled for example by the processing unit 7 acting alone or in conjunction with a keyboard provided in control unit 8, each check is diverted either directly as a function of the information read from the check when the machine 1 is operating independently, or as a function of additional information obtained from a dialogue between the machine 1 and a central data processing system.

Figure 2:
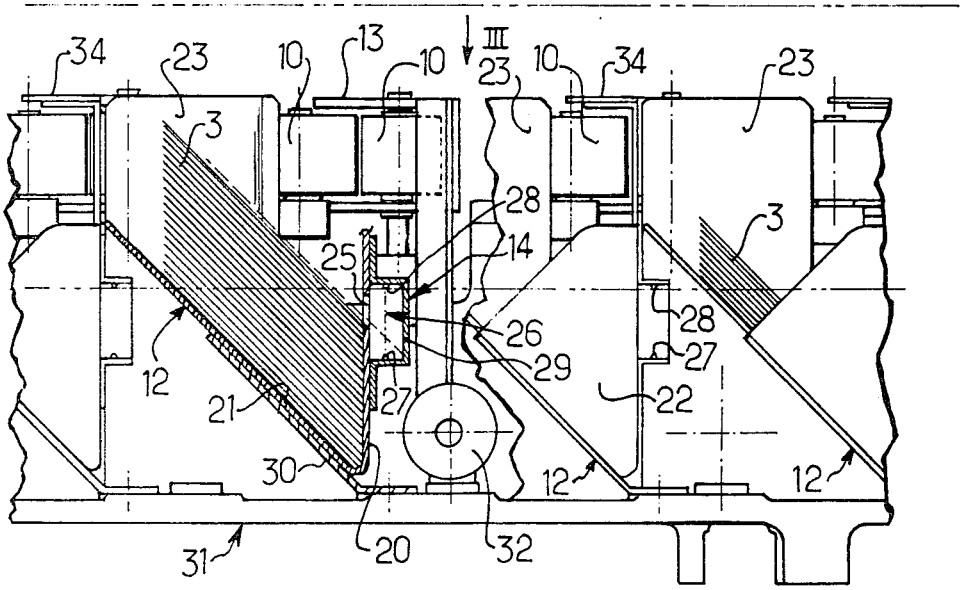
FIG. 2 is a fragmentary partial view, looking along arrow II of FIG. 1, showing details of the hopper of the present invention.
Figure 3:
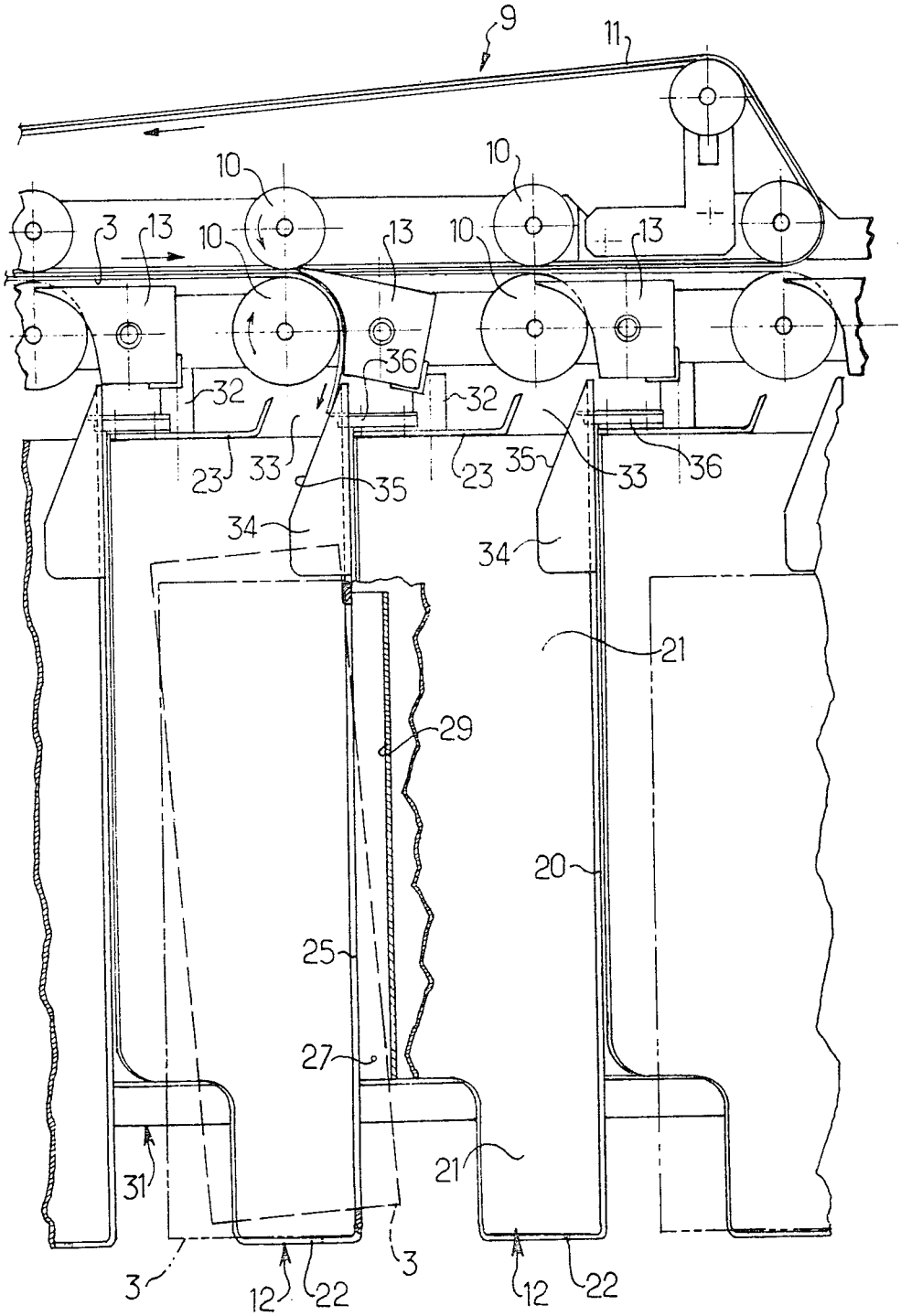
FIG. 3 is an enlarged fragmentary view along arrow III of FIG. 2 to illustrate the operation of the detection system of the invention.

Referring to FIGS. 2 and 3, there will be described in detail the details of the present invention, which is the receiving hoppers 12, each associated with a detecting system 14 for detecting a full condition in a hopper 12.

A hopper 12 is defined on the one hand by two longitudinal walls 20, 21 which form a certain angle between them and whose common longitudinal edge defines the bottom of the hopper 12. In the embodiment as shown in FIG. 2, longitudinal wall 20 is substantially vertical and longitudinal wall 21 makes an angle of substantially 45° with longitudinal wall 20. As can clearly be seen in FIG. 2, longitudinal wall 20 is intended to act as a retaining surface for the lower longitudinal edges of the sheets 3, thus enabling the sheets to be held in the hopper, while longitudinal wall 21 acts as a base or supporting surface for the same sheets. The two ends of longitudinal walls 20, 21 are provided with respective oppositely facing transverse walls 22, 23 (FIG. 3).

The detection system 14 associated with each hopper 12 includes at least one slot 25 provided in one wall of the hopper 12 and means 26 for detection when a hopper is full, full being defined as when a predetermined number of checks have been accumulated in the hopper or when the stack of checks reaches a predetermined level.

Preferably, the slot 25 is advantageously provided in longitudinal wall 20 of the hopper 12. This slot 25 extends substantially parallel to the common edge of the two longitudinal walls 20 and 21 and extends from transverse wall 22 of the hopper 12 for a length greater than half the length of the sheets 3 which are intended to be received by the hopper. The slot 25 is situated at a certain height above the common edge of the two longitudinal walls 20 and 21, its position defining the limit of filling the hopper.

The detection system 26, in the preferred embodiment shown, includes two photo-elements, namely a light emitter 27 and a light receiver 28 which are mounted on respective sides of the slot 25. These two elements 27 and 28 are carried by a U-shaped support 29 which is fitted to the outside of the hopper 21 on longitudinal wall 20 and parallel thereto, in such a way that the slot opens into the interior of the U-shaped support 29. The photo-elements 27, 28 are fitted to the facing lateral surfaces of the U-shaped support 29. Referring in particular to FIG. 3, it can be seen that the support 29 does not extend for the entire length of the slot 25, thus leaving open the end of the slot adjacent transverse wall 22 of the hopper 12.

Close to the ends of its longitudinal walls 20, 21 each hopper 12 is held in position by two substantially vertical plates 30 carried by a framework 31 which may be the framework of the sorting machine.

Sheets 3, as best shown in FIG. 3, enter at the point where transverse wall 23 of the hopper 12, i.e. the wall furtherest from the slot 25 is situated. As shown in FIG. 3, in the conveyor arrangement 9, a sheet 3 is held between the belt 11 and the guide rollers 10. At the entrance to each hopper 12, there is a diverting device 13 or two-position switch. In one position a given switch 13 allows the sheet to continue along the conveyor 9 towards the next hopper 12. In a second position, diverter 13 directs the sheet 3 into the associated hopper 12. The switches 13 are controlled by means of electromagnets 32 shown in FIG. 2, which are operated in a known manner for example, by the processor unit 7 and/or the control unit 8.

Referring again to FIG. 3, transverse wall 23 of each hopper 12 extends from longitudinal wall 21 to a point short of longitudinal wall 20, thus defining an opening 33 for the sheets 3 to pass through between the edge of wall 23 and end of wall 20.

It should be noted that each hopper 12 is disposed at a level lower than the conveyor 9, so that the sheets 3 enter the associated hopper 12 in the upper region of transverse wall 23. A guiding member 34 is provided at the top of longitudinal wall 20 at its end adjacent the transverse wall 23. A guide member 34 on wall 20 extends substantially towards the inside of the hopper in a direction substantially perpendicular to longitudinal wall 20. At its free end, the guiding member 34 has an inclined section 35 which enables a sheet 3 entering the hopper 12 to be guided away from wall 20 and towards the longitudinal supporting wall 21.

A description will now be given of the way in which the sheets 3 stack up in a hopper 12 and of the way in which the detection system is triggered when the height of the stack of sheets 3 present in the hopper 12 is close to that of the slot 25.

Referring in particular to FIG. 3, it will be assumed that all of the sheets 3 are to be received in one and the same hopper 12. Under these conditions, the diverting device 13 associated with this hopper is set, in relation to the path of the sheets 3 through the conveyor 9, in such a way as to direct each sheet 3 into the associated hopper 12. A sheet 3 will thus be presented to the hopper 21 in a substantially vertical plane, i.e. on edge, and is directed by way of the guiding element 34 towards the longitudinal supporting wall 21. As the sheet 3 leaves the conveyor belt 9 and is diverted toward wall 21 it tends to fall by gravity and come into contact with the inclined longitudinal wall 21 and to slide on this wall finally coming to rest with the whole of its surface in contact with the longitudinal supporting wall 21 of the hopper 12. The sheet 3 thus positions itself in the hopper 12 parallel to the inclined longitudinal wall 21 and it is held in this position by reason of the fact that its lower longitudinal edge comes to bear against the longitudinal retaining wall 20 of the hopper 12. Naturally, when the first sheet has positioned itself inside the hopper 12, the next sheet 3, as it enters the hopper 12, will no longer slide on the longitudinal wall 21 proper but instead on the sheet 3 previously received in the hopper. Thus, it is advantageous to provide, at the entry to the hopper 12 and in the immediate vicinity of transverse wall 23, a static charge removing device 36 which makes sliding contact with sheet 3 as it enters the hopper 12 to remove any static electricity in order to prevent any two successive sheets from sticking together.

When the height of the stack of sheets 3 received in the hopper 12 is close to that of the slot 25 there will come a time when a sheet which enters the hopper 12 and slides by gravity over the sheet 3 previously received will no longer be retained within the hopper, because its lower longitudinal edge will not strike the retaining surface formed by the longitudinal wall 20. Under these conditions the leading end of the sheet will tend to enter the slot 25. Part of the sheet will enter the U-shaped support 29 and will intercept the light ray emitted by the emitting element 27 of the detecting arrangement 26 to cause a signal to be developed indicative of the full condition of the hopper. This signal is developed as soon as this ray is occluded by the sheet 3. Since the receiver element 28 is no longer receiving a light signal, it is effectively de-energized, and a responsive control device (not shown) may for example trigger an audio or visual signal, situated for example on the unit 8, to indicate that a receiving hopper 12 is full and/or may interrupt or modify the transportation and/or the sorting of succeeding by means of some suitable control arrangement (not shown).

If the detection system is to operate properly, it is of course desirable for the length of the hopper to be substantially greater than the length of one sheet in order to allow the sheet 3, which would normally trigger the detection system, to slide over the previous sheet and its leading part to engage in the slot 25 before its leading edge comes into abutment against the transverse wall 22. A reception hopper of this kind with its associated detection system involves a simple, low-cost structure. In addition, an important fact which should be noted is that the detection system has no moving parts and thus ensures excellent reliability.

In the embodiment shown, the checks are fed on edge at the point where one transverse wall of the hopper is situated by a conveyor, but it is readily possible for checks to be fed in in some other way, as for example through the top of the hopper, in which case a sheet slides over the previous sheets substantially parallel to them and the first sheet which triggers the detection system will engage in the slot by pivoting about one end of the slot.

The invention is not of course in any way restricted to the embodiment described and illustrated, which is given merely by way of example. In particular, it embraces all means which form technical equivalents of the means described, as well as combinations of these if the combinations are made in accordance with the spirit of the invention and are employed in the context of the following claims.

We claim:

1. A hopper for receiving documents such as flat sheets fed from a conveyor and adapted to be stacked atop one another inside the hopper, comprising at least one supporting surface for said sheets and at least one retaining surface, at least one slot provided in the retaining surface through which a sheet projects when a quantity of sheets has been accumulated in the hopper to a predetermined height, said slot being disposed at said predetermined height on said surface and detection means adjacent said slot for detecting when said hopper has accumulated said quantity of sheets and at least a part of a sheet projects out of the hopper through the slot.

2. A hopper according to claim 1, wherein said detection means is arranged to detect the presence of that part of a sheet which has projected through said slot.

3. A hopper according to claim 1 or 2, wherein said detection means includes at least one light emitting member and at least one light receiver, said member and said receiver being mounted on respective sides of said slot on the outside of the said hopper.

4. A hopper according to claim 1 or 2, wherein the space within the hopper is defined on the one hand by said supporting surface and said retaining surface, said surfaces being arranged to form a certain angle between them and having a common longitudinal edge defining the bottom of the hopper, said surfaces extending longitudinally in the direction of feed of the sheets and at least one transverse wall connected to one end to one of said surfaces.

5. A hopper according to claim 4, wherein the retaining surface is a substantially vertical wall.

6. A hopper according to claim 5, wherein the supporting surface is a longitudinal wall at substantially 45° to the said retaining surface wall.

7. A hopper according to claim 4, wherein said slot is substantially parallel to the common edge of the said two surfaces.

8. A hopper according to claim 4, wherein said slot extends substantially from said at least one transverse wall of the hopper for a length substantially greater than half the length of the said sheets and said hopper having a second transverse wall connected to the other end of said supporting surface.

9. A hopper according to claim 8, wherein the end of the slot opposite the said at least one transverse wall forms a pivoting surface for the first sheet which is caused to project through the said slot.

10. A hopper according to claim 8, wherein said slot extends a distance less than the length of a sheet such that the entry of the sheet into said slot takes place at the region of the second transverse wall of the hopper opposite to the said at least one transverse wall from which said slot extends.

11. A hopper according to claim 4, wherein said conveyor includes a drive belt and rollers for feeding said sheets on edge.

12. A hopper according to claim 4, wherein said slot extends substantially from said at least one transverse wall of the hopper for a length substantially greater than half the length of the said sheets.

13. A hopper according to claim 4, wherein said hopper includes a second transverse wall connected to the other end of said supporting surface.

* * * * *